US010524541B2

(12) United States Patent
Lo

(10) Patent No.: US 10,524,541 B2
(45) Date of Patent: Jan. 7, 2020

(54) FOOTWEAR ASSEMBLY

(71) Applicant: Chih-Fang Lo, Taichung (TW)

(72) Inventor: Chih-Fang Lo, Taichung (TW)

( * ) Notice: Subject to any disclaimer, the term of this patent is extended or adjusted under 35 U.S.C. 154(b) by 75 days.

(21) Appl. No.: 15/832,643

(22) Filed: Dec. 5, 2017

(65) Prior Publication Data

US 2019/0166953 A1 Jun. 6, 2019

(51) Int. Cl.

| | |
|---|---|
| ***A43B 23/07*** | (2006.01) |
| ***A43B 7/12*** | (2006.01) |
| ***A43B 1/00*** | (2006.01) |
| ***A43B 23/02*** | (2006.01) |
| ***A43B 23/26*** | (2006.01) |
| ***A43B 23/24*** | (2006.01) |
| ***A43B 19/00*** | (2006.01) |
| ***A43B 17/18*** | (2006.01) |
| ***A43B 7/20*** | (2006.01) |
| ***A43B 3/00*** | (2006.01) |

(52) U.S. Cl.

CPC ..... *A43B 23/07* (2013.01); *A43B 1/0027* (2013.01); *A43B 1/0072* (2013.01); *A43B 1/0081* (2013.01); *A43B 3/0078* (2013.01); *A43B 7/12* (2013.01); *A43B 7/20* (2013.01); *A43B 17/18* (2013.01); *A43B 19/00* (2013.01); *A43B 23/02* (2013.01); *A43B 23/0245* (2013.01); *A43B 23/0295* (2013.01); *A43B 23/24* (2013.01); *A43B 23/26* (2013.01)

(58) Field of Classification Search

CPC ..... A43B 23/07; A43B 23/0245; A43B 23/26; A43B 23/24; A43B 23/02; A43B 23/0295; A43B 1/0081; A43B 1/0072; A43B 1/0027; A43B 7/12; A43B 7/20; A43B 3/0078; A43B 17/18; A43B 19/00

USPC ..... 36/93, 136, 10, 55, 9 R

See application file for complete search history.

(56) References Cited

U.S. PATENT DOCUMENTS

| | | | | | |
|---|---|---|---|---|---|
| 520,417 | A | * | 5/1894 | Foss | A43B 23/28 36/10 |
| 806,267 | A | * | 12/1905 | King | A43B 23/26 36/114 |
| 1,184,013 | A | * | 5/1916 | Pierce | A43B 23/26 36/54 |
| 1,240,082 | A | * | 9/1917 | Nathan | A41D 17/00 36/2 R |
| 1,275,895 | A | * | 8/1918 | Fox | A43B 23/26 36/54 |
| 1,309,958 | A | * | 7/1919 | Phillips | A43B 23/26 36/54 |
| 1,355,323 | A | * | 10/1920 | Fox | A43B 23/26 36/54 |

(Continued)

*Primary Examiner* — Alissa J Tompkins
*Assistant Examiner* — Dakota Marin

(57) ABSTRACT

A footwear assembly includes a shoe having a vamp and an outsole. The shoe includes a first room defined between the vamp and the outsole, and a first opening is formed in the top of the shoe and communicates with the first room. A first connection member is located on outside of the first opening. A water-proof sock is inserted in the first room via the first opening, and has a neck portion formed along the second opening of the water-proof sock. The neck portion is able to be foldable relative to the water-proof sock and has a second connection member which is connected to the first connection member when the neck portion is foldable relative to the water-proof sock.

6 Claims, 6 Drawing Sheets

(56) References Cited

U.S. PATENT DOCUMENTS 1,606,862 A * 11/1926 Zenishek ..... A41D 17/00 36/2 R
1,711,851 A * 5/1929 Langdon ..... A43B 23/07 36/55
2,344,415 A * 3/1944 Neva ..... A41D 17/00 36/2 R
3,419,974 A * 1/1969 Lange ..... A43B 1/0018 12/142 R
4,169,324 A * 10/1979 Gibbs ..... A43B 17/18 2/239
4,187,619 A * 2/1980 Gibbs ..... A43B 17/18 2/240
5,483,704 A * 1/1996 Filipiak ..... A41F 13/00 2/239
5,499,459 A * 3/1996 Tomaro ..... A43B 1/0045 36/10
5,544,430 A * 8/1996 Jacko ..... A43B 3/16 36/100
5,826,353 A * 10/1998 Woznicki ..... A43B 23/26 36/54
7,051,459 B1 * 5/2006 Wigutow ..... A43B 23/06 36/10
7,200,958 B2 * 4/2007 Kim ..... A43B 1/0081 36/127
8,261,470 B2 * 9/2012 Wines ..... A43B 3/0078 36/100
8,474,062 B2 * 7/2013 Taylor ..... A41D 31/085 2/22
9,936,764 B2 * 4/2018 Lo ..... A43B 7/12
2002/0029496 A1 * 3/2002 Morle ..... A43B 5/02 36/99
2002/0139009 A1 * 10/2002 Mark ..... A43B 7/18 36/54
2003/0115777 A1 * 6/2003 Hall ..... A43B 3/0031 36/117.6
2003/0131498 A1 * 7/2003 Liang ..... A43B 7/12 36/55
2004/0250452 A1 * 12/2004 Farys ..... A43B 5/002 36/89
2005/0011083 A1 * 1/2005 Kosted ..... A43B 1/0081 36/9 R
2006/0051566 A1 * 3/2006 Challe ..... A43B 23/0255 428/304.4
2007/0227037 A1 * 10/2007 Kao ..... A43B 3/106 36/10
2008/0052955 A1 * 3/2008 Barrow ..... A43B 5/0405 36/2.6
2010/0236100 A1 * 9/2010 Ho ..... A43B 1/0081 36/100
2014/0196318 A1 * 7/2014 Verheem ..... A43B 1/0081 36/100

* cited by examiner

FOOTWEAR ASSEMBLY

BACKGROUND OF THE INVENTION

1. Fields of the Invention

The present invention relates to a footwear assembly, and more particularly, to a shoe with a water-proof sock which is inserted into the shoe and replaceable.

2. Descriptions of Related Art

The conventional shoes generally includes an outsole with a vamp connected to the top of the outsole, and a room is defined between the outsole and the vamp. In order to provide more features, some of the shoes are made of watertight and breathable material which is used on the vamp so as to allow air to pass the through so as to keep the interior of the shoes cool, while rater drops cannot penetrate through the material. However, these shoes fabricated by the watertight and breathable material are expensive. Besides, once there is a small holes formed in the vamp, the water drop may enter the shoe, although the rest portion of the shoe is in good shape. Furthermore, water may flow into the shoe along the legs of pants in rainy days, and makes the wearer uncomfortable.

The present invention intends to provide a footwear assembly which includes a shoe with a water-proof sock which eliminates the shortcomings mentioned above.

SUMMARY OF THE INVENTION

The present invention relates to a footwear assembly and comprises a shoe having a vamp and an outsole. The vamp is connected to the outsole so as to define a first room in the shoe. The shoe includes a first opening which is located on the top of the shoe and communicates with the first room. A first connection member is located on outside of the shoe and located at outside of the first opening. A water-proof sock is inserted in the first room via the first opening, and has a second room and a second opening. A neck portion is formed along the second opening, and is foldable relative to the water-proof sock. The neck portion has a second connection member which is connected to the first connection member when the neck portion is foldable relative to the water-proof sock.

Preferably, the shoe includes a first tongue which extends toward the first opening, and the first tongue has a folding plate located at the distal end thereof. The folding plate has a first positioning member formed on the inside thereof which faces the first opening. The water-proof sock includes a second tongue which extends toward the second opening of the water-proof sock. The second tongue has a second positioning member formed on the inside thereof which faces the second opening. When the second tongue is located between the first tongue and the folding plate that is folded toward the water-proof sock, the first and second positioning members are connected to each other.

Preferably, the neck portion includes multiple hooking members on the outside thereof. Each hooking member includes a base and a hook portion. The base has the first end thereof connected to the neck portion, and the hook portion is formed on the second end of the base corresponding thereto. A hooking slot is defined between the base and the hooking portion of each hooking member. Each hooking slot opens toward a direction that is opposite to the first tongue.

Preferably, the neck portion includes multiple snapping members connected to an outside thereof.

Preferably, the first and second connection members each are a hook-and-loop strip.

Preferably, the first and second positioning members each are a hook-and-loop strip.

Preferably, a sponge sheet 8 is located between the first tongue and the folding plate.

By the connection of the first and second connection members, the footwear effectively avoids water from entering into the shoe via the first opening. Similarly, the water on the lets of pants is guided to the vamp and does not flow into the shoe.

The water-proof sock is replaceable so as to keep the feet dray and comfortable.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
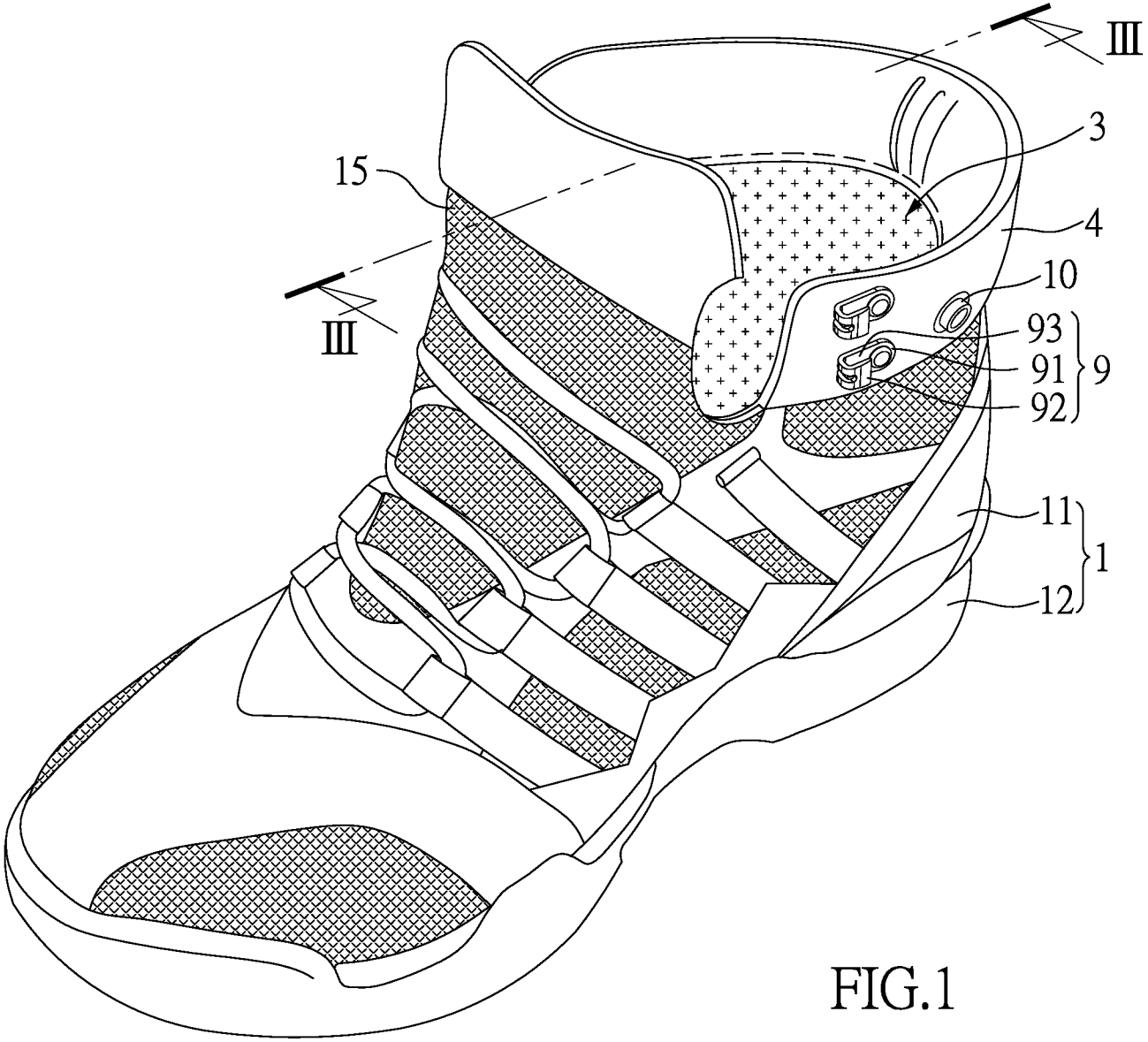
FIG. 1 is a perspective view to show the footwear assembly of the present invention.
Figure 2:
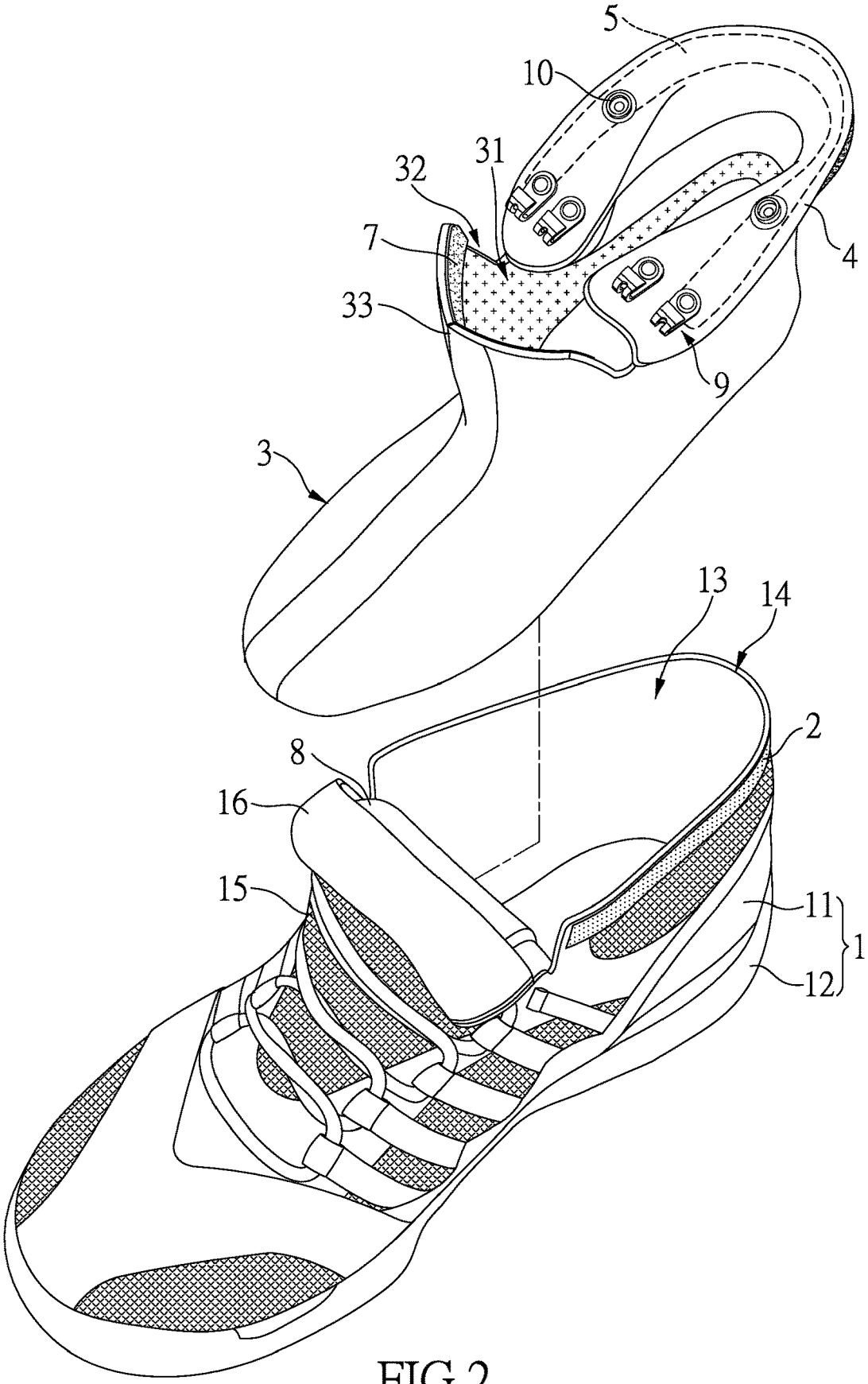
FIG. 2 is an exploded view of the footwear assembly of the present invention.

Referring to FIGS. 1 to 6, the footwear assembly of the present invention comprises a shoe 1 and a water-proof sock 3. The shoe 1 includes a vamp 11 and an outsole 12. The vamp 11 is connected to the outsole 12 so as to define a first room 13 in the shoe 1. The shoe 1 includes a first opening 14 which is located on the top of the shoe 1 and communicates with the first room 13. A first connection member 2 is located on outside of the shoe 11 and located at outside of the first opening 14. The water-proof sock 3 is inserted in the first room 13 via the first opening 14, and has a second room 31 and a second opening 32 which is located on the top of the water-proof sock 3. A neck portion 4 is formed along the second opening 32 and is foldable relative to the water-proof sock 3. The neck portion 4 has a second connection member 5 which is connected to the first connection member 2 when the neck portion 4 is foldable relative to the water-proof sock 3. In this embodiment, the first and second connection members 2, each are a hook-and-loop strip. The neck portion 4 further includes multiple hooking members 9 and multiple snapping members 10 located on the outside thereof. Each hooking member 9 includes a base 91 and a hook portion 92. The base 91 has the first end thereof connected to the neck portion 4, and the hook portion 92 is formed on the second end of the base 91 corresponding thereto. A hooking slot 93 is defined between the base 91 and the hooking portion 92 of each hooking member 9. Each hooking slot 93 opens toward the direction that is opposite to the first tongue 15.

The hooking members 9 can be cooperated with the shoelaces (not shown) to further secure the footwear assembly. The multiple snapping members 10 may be connected with snapping members on the pants to secure the legs of the pants to the water-proof sock 3. Therefore, water on the legs of the pants will not flow into the shoe 1. The snapping members 10 may also be connected with snapping members on boots (not shown) or the like.

The water-proof sock 3 is replaceable relative to the shoe 1. The first connection member 2 is connected to the second connection member 5 to position the water-proof sock 3 in the shoe 1. The footwear assembly of the present invention effectively avoids water from entering into the shoe 1 via the first opening 14. The water on the lets of pants is guided to the vamp 11 and does not flow into the shoe 1. The water-proof sock 3 is replaceable relative to the shoe 1 so that the users can replace a new and dry water-proof sock 3 when needed so as to keep the feet dray and comfortable.

Figure 3:
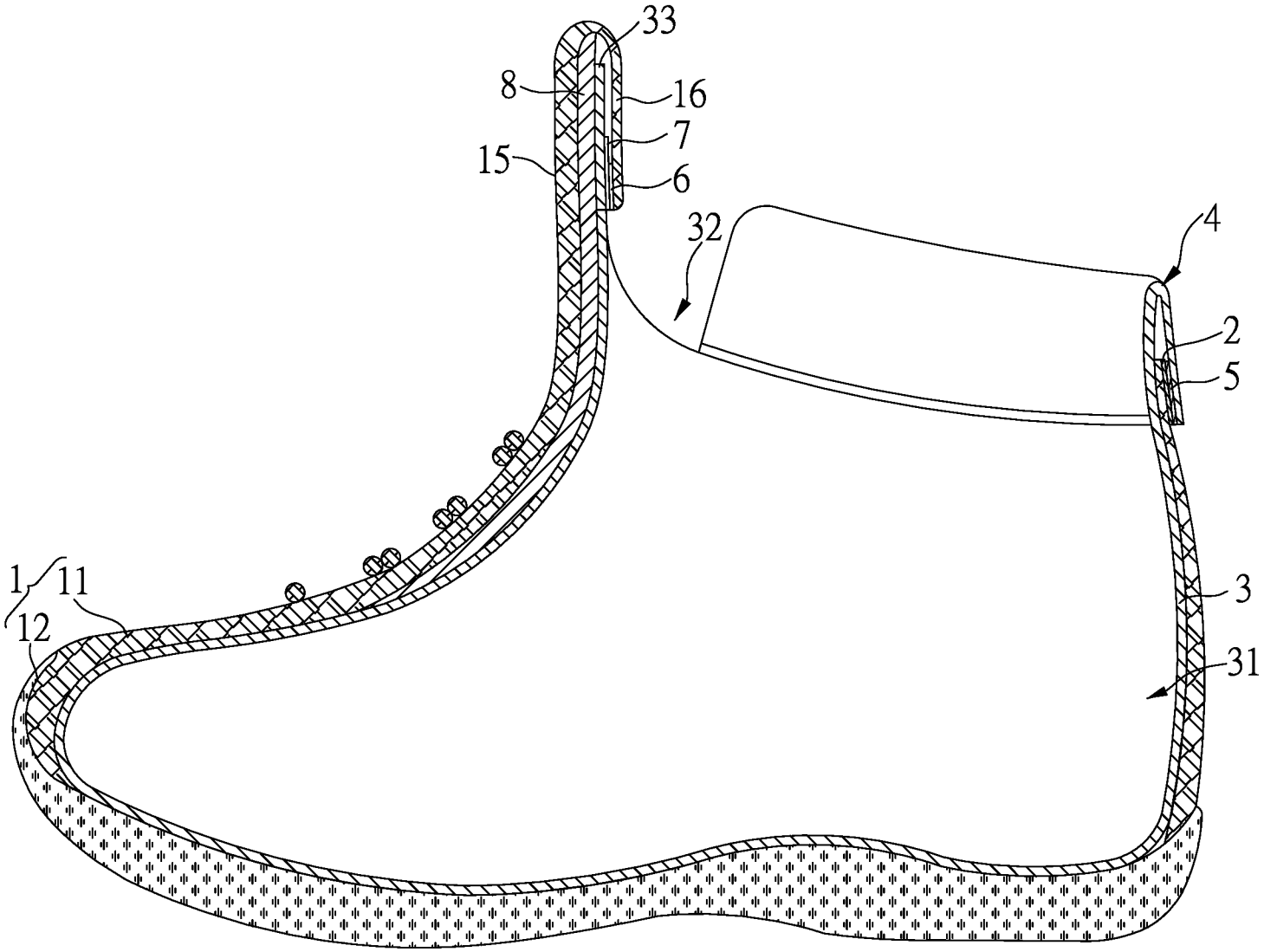
FIG. 3 is a cross sectional view, taken along line III-III in FIG. 1.
Figure 4:
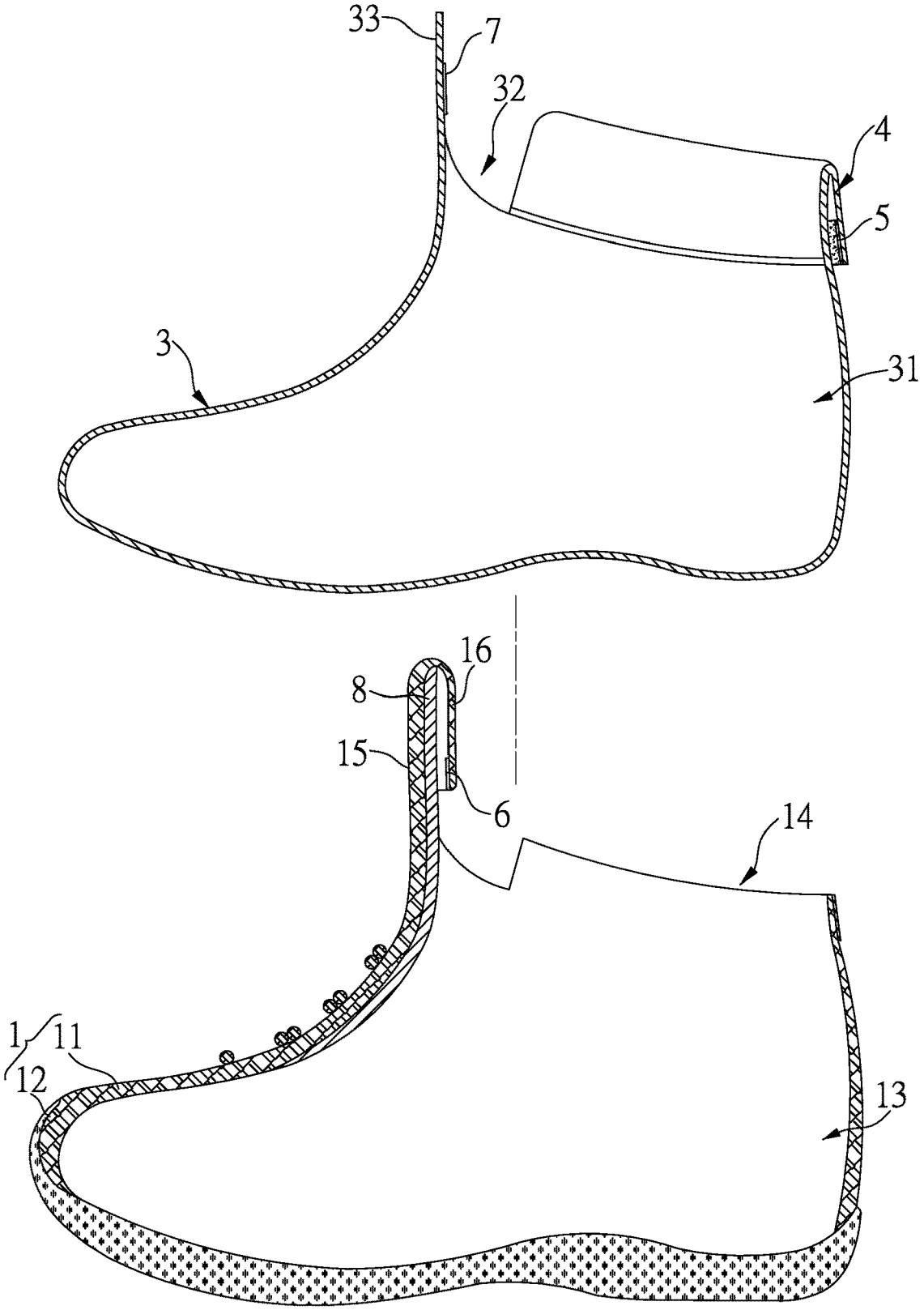
FIG. 4 is a cross sectional view to show the shoe and the water-proof sock of the footwear assembly of the present invention.
Figure 5:
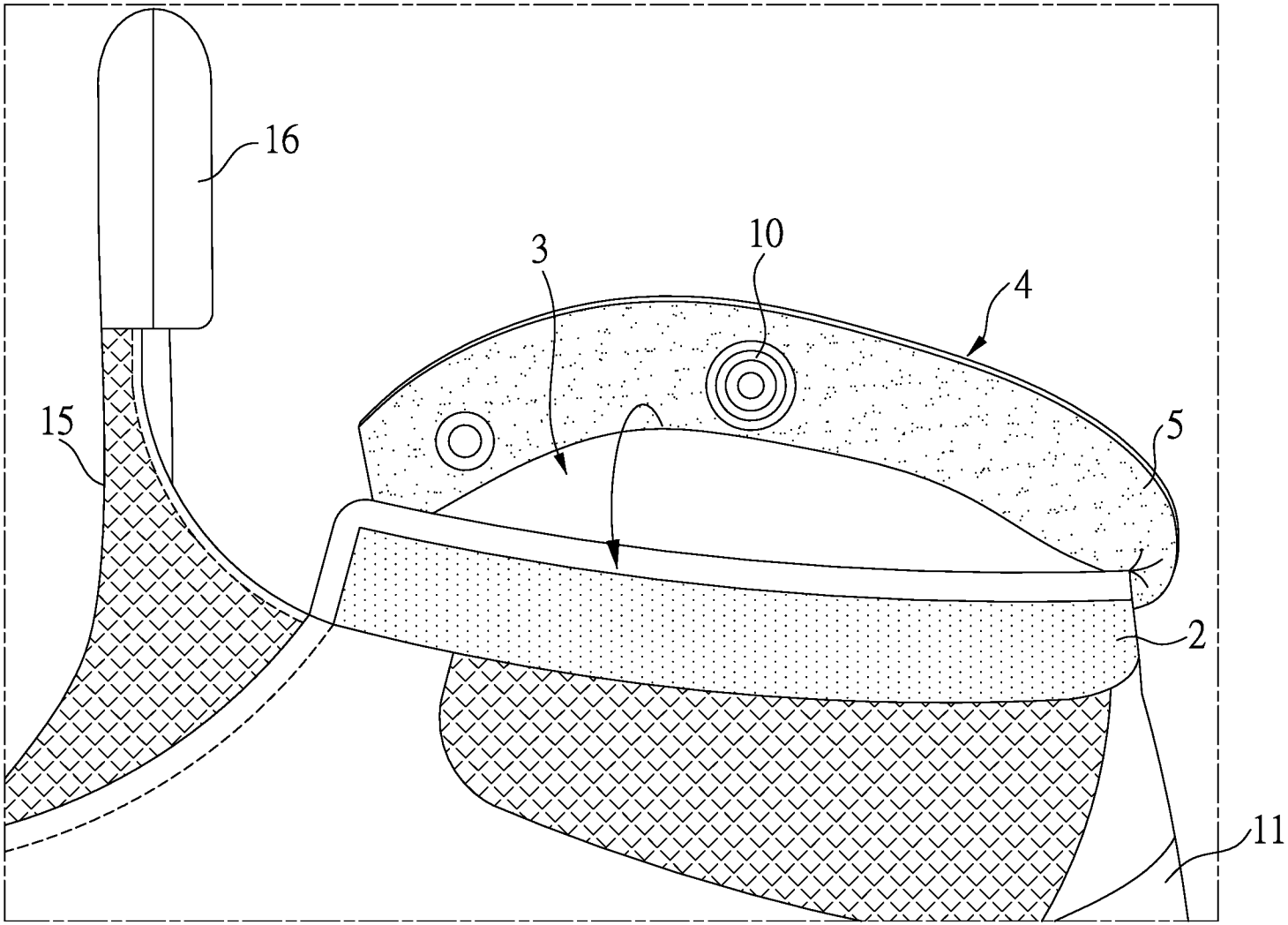
FIG. 5 is an enlarged view to show the neck portion of the water-proof sock connected to the vamp of the shoe.
Figure 6:
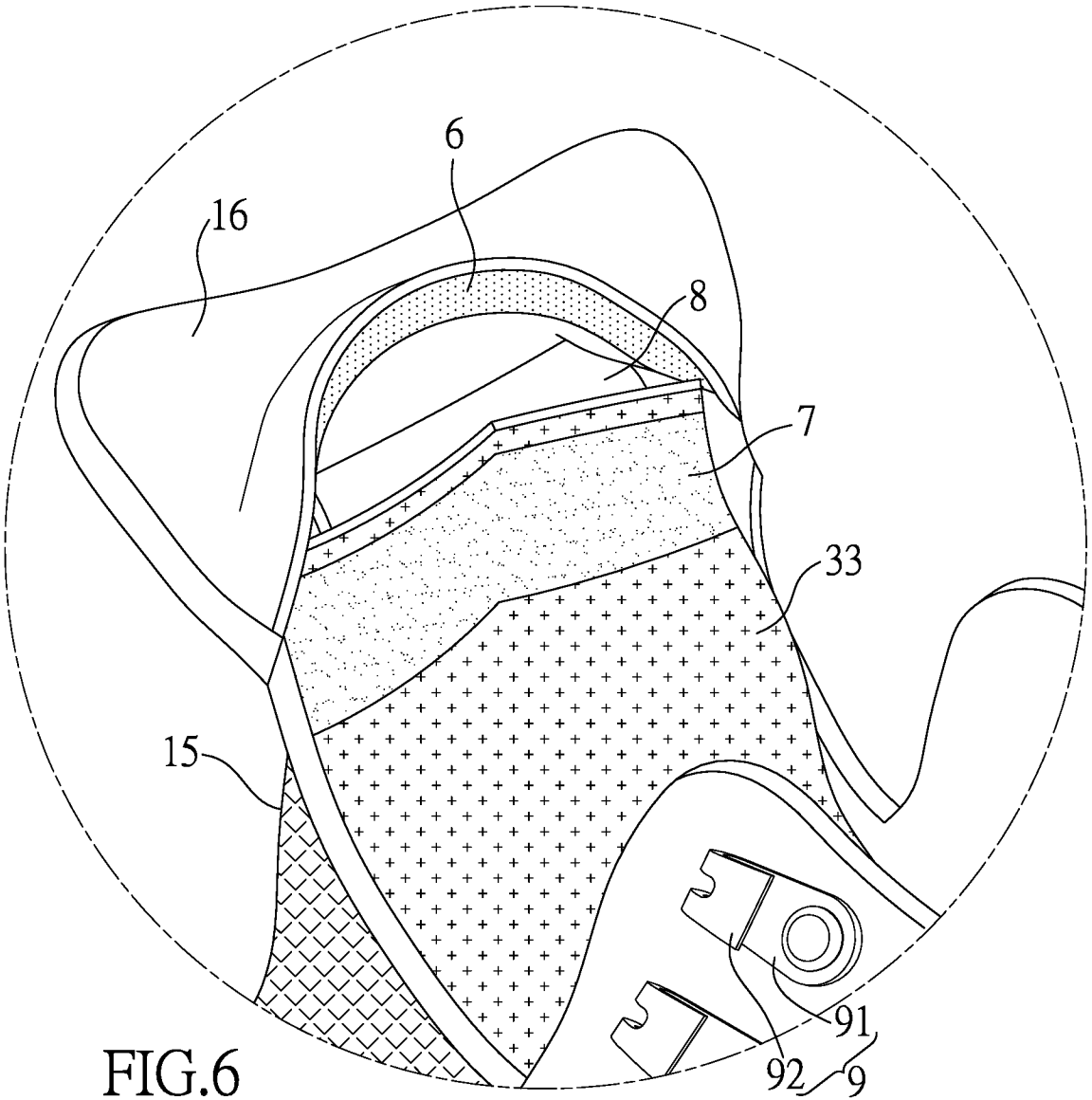
FIG. 6 is an enlarged view to show the first tongue of the shoe and the second tongue of the water-proof sock.

As shown in FIGS. 3, 4 and 6, the shoe 1 includes a first tongue 15 which extends toward the first opening 14, and the first tongue 15 has a folding plate 16 located at the distal end thereof. The folding plate 16 has a first positioning member 6 formed on the inside thereof which faces the first opening 14. A sponge sheet 8 is located between the first tongue 15 and the folding plate 16 so that the users may feel comfortable when wearing the footwear. The water-proof sock 3 includes a second tongue 33 which extends toward the second opening 32 of the water-proof sock 3. The second tongue 33 has a second positioning member 7 formed on the inside thereof which faces the second opening 32. When the second tongue 33 is located between the first tongue 15 and the folding plate 16 that is folded toward the water-proof sock 3, the first and second positioning members 6, 7 are connected to each other. In this embodiment, the first and second positioning members 6, 7 each are a hook-and-loop strip.

The water-proof sock 3 is made of breathable and water-proof material. The water-proof sock 3 is replaceable so that the users can replace the water-proof sock 3 when needed, while the shoe 1 is repeatedly used.

The water-proof sock 3 is secured to the shoe 1 by the connection of the first and second connection members 2, 5, and by the connection of the first and second positioning members 6, 7. The specific arrangement to the first and second tongues 15, 33 ensures that the water-proof sock 3 is not separated from the shoe 1 easily.

The neck portion 4 is folded and connected to the vamp 11 of the shoe 1 so that the water outside of the shoe 1 cannot flow into the shoe 1. The water on the legs of pants is guided to flow downward and does not enter into the shoe 1.

While we have shown and described the embodiment in accordance with the present invention, it should be clear to those skilled in the art that further embodiments may be made without departing from the scope of the present invention.

What is claimed is:

1. A footwear assembly comprising:

a shoe having a vamp and an outsole, the vamp connected to the outsole so as to define a first room in the shoe, the shoe including a first opening which is located on a top of the shoe and communicates with the first room, a first connection member located on an outside of the shoe and located at an outside of the first opening, the shoe including a first tongue which extends toward the first opening, the first tongue having a folding plate located at a distal end thereof, the folding plate having a first positioning member formed on an inside thereof which faces the first opening, and a water-proof sock inserted in the first room via the first opening and having a second room and a second opening, the water-proof sock including a second tongue which extends toward the second opening of the water-proof sock, the second tongue having a second positioning member formed on an inside thereof which faces the second opening, the second tongue located between the first tongue and the folding plate, the folding plate being folded into the second opening of the water-proof sock, the first and second positioning members being connected to each other, a neck portion formed along the second opening and having a second connection member, the neck portion being folded to the outside of the shoe, and the second connection member connected to the first connection member.

2. The footwear assembly as claimed in claim 1, wherein the neck portion includes multiple hooking members on an outside thereof, each hooking member includes a base and a hook portion, the base has a first end thereof connected to the neck portion, the hook portion is formed on a second end of the base corresponding thereto, a hooking slot is defined between the base and the hooking portion of each hooking member, each hooking slot opens toward a direction that is opposite to the first tongue.

3. The footwear assembly as claimed in claim 1, wherein the neck portion includes multiple snapping members connected to an outside thereof.

4. The footwear assembly as claimed in claim 3, wherein the first and second connection members each are a hook-and-loop strip.

5. The footwear assembly as claimed in claim 1, wherein the first and second positioning members each are a hook-and-loop strip.

6. The footwear assembly as claimed in claim 5, wherein a sponge sheet is located between the first tongue and the folding plate.

* * * * *